US012285115B2

(12) United States Patent
Law

(10) Patent No.: US 12,285,115 B2
(45) Date of Patent: Apr. 29, 2025

(54) CONNECTION BRACKET STRUCTURE BETWEEN SEAT CUSHION AND CHAIR BACK

(71) Applicant: IGO FURNITURE (GAO AN) LIMITED, Yichun (CN)

(72) Inventor: Chi Po Law, Foshan (CN)

(73) Assignee: IGO FURNITURE(GAO AN) LIMITED, Yichun (CN)

( * ) Notice: Subject to any disclaimer, the term of this patent is extended or adjusted under 35 U.S.C. 154(b) by 197 days.

(21) Appl. No.: 18/136,717

(22) Filed: Apr. 19, 2023

(65) Prior Publication Data

US 2023/0337826 A1 Oct. 26, 2023

(51) Int. Cl.
*A47C 7/02* (2006.01)

(52) U.S. Cl.
CPC ..... *A47C 7/02* (2013.01)

(58) Field of Classification Search
CPC ..... A47C 7/02
USPC ..... 297/440.2, 440.22, 463.1, 463.2
See application file for complete search history.

(56) References Cited

U.S. PATENT DOCUMENTS

| | | | | |
|---|---|---|---|---|
| 3,089,730 | A * | 5/1963 | Mauser | A47C 5/04 297/440.22 |
| 6,739,671 | B2 * | 5/2004 | De Maina | B60N 2/7029 297/440.22 |
| 8,696,066 | B2 * | 4/2014 | Mizobata | B60N 2/7011 297/440.22 |
| 2007/0284930 | A1 * | 12/2007 | Christianson | A47C 7/742 297/440.22 |

* cited by examiner

*Primary Examiner* — Anthony D Barfield
(74) *Attorney, Agent, or Firm* — Birchwood IP

(57) ABSTRACT

A connection bracket structure between seat cushion and chair back relates to the technical field of connection between an office chair backpack and a seat cushion, comprising a seat cushion, one side of the seat cushion is provided with a support frame, and one side of the support frame is provided with a cross frame, a side of the support frame opposite to the cross frame is provided with a chair back, the cross frame, the support frame and the chair back are rotatably connected by fastening screws, one side of the cross frame is fixedly provided with positioning bump a, a side of the support frame opposite to the positioning bump a is configured to be an arc-shaped concave structure, one side of the support frame is provided with positioning bump b, and surface of the positioning bump b are also formed into a concave structure.

6 Claims, 6 Drawing Sheets

CONNECTION BRACKET STRUCTURE BETWEEN SEAT CUSHION AND CHAIR BACK

CROSS-REFERENCE TO RELATED APPLICATIONS

This application claims the benefit and priority of Chinese patent application No. 202220948762.4, filed on Apr. 23, 2022, disclosure of which is hereby incorporated by reference in its entirety.

TECHNICAL FIELD

The present application provides a connection bracket structure between seat cushion and chair back.

BACKGROUND

The swivel chair, can also be called a desk chair, which belongs to the office chair category and is a chair that can sit and turn. The existing structural connectors of office swivel chair backs are mostly connected by plastics, hardware, and wood (wooden board) accessories, while the general plastic back is connected to the seat cushion through the direct composite connection part of the armrest, bracket or plastic back. However, when most of these connection methods achieve the requirements of the appearance and strength of the product, the product will take up a relatively large packaging space when it is disassembled and packaged, thereby resulting in higher transportation costs, resulting in a higher overall positioning of the product and makes some consumers not choose it.

SUMMARY

The purpose of the present application is to propose a connection bracket structure between a seat cushion and a chair back in order to solve the shortcomings in the prior art.

In order to achieve the above object, the present application adopts the following technical solutions: a connection bracket structure between seat cushion and chair back comprising a seat cushion, one side of the seat cushion is provided with a support frame, and one side of the support frame is provided with a cross frame, a side of the support frame opposite to the cross frame is provided with a chair back, the cross frame, the support frame and the chair back are connected by fastening screws.

In order to facilitate the connection of the cross frame, the present application proposes that one side of the cross frame is fixedly provided with positioning bump a, a side of the support frame opposite to the positioning bump a is configured to be an arc-shaped concave structure.

In order to connect the support frame, the present application proposes that one side of the support frame is provided with positioning bump b, and surface of the positioning bump b are also formed into a concave structure.

In order to fit the support frame to the chair back, the present application proposes that one side of the chair back opposite to the positioning bump b is fixed with positioning bump c, and the positioning bump c are symmetrically distributed on surface of the chair back.

In order to improve the strength of the support frame, the present application proposes that the support frame and the cross frame are configured to be bent structures.

In order to connect the support frame, cross frame and chair back, the present application proposes that threaded holes are provided inside the chair back, and the threaded holes are engaged with fastening screws.

Compared with the prior art, the advantages and positive effects of the present application are: In the present application, in actual use, by providing cushions, support frames, cross frames, chair backs and fastening screws, and by changing the structure of the connection bracket, the connection bracket can be disassembled and assembled without affecting the overall appearance. While ensuring product strength and appearance, the size of product packaging is also effectively reduced.

REFERENCE SIGNS

Figure 1:
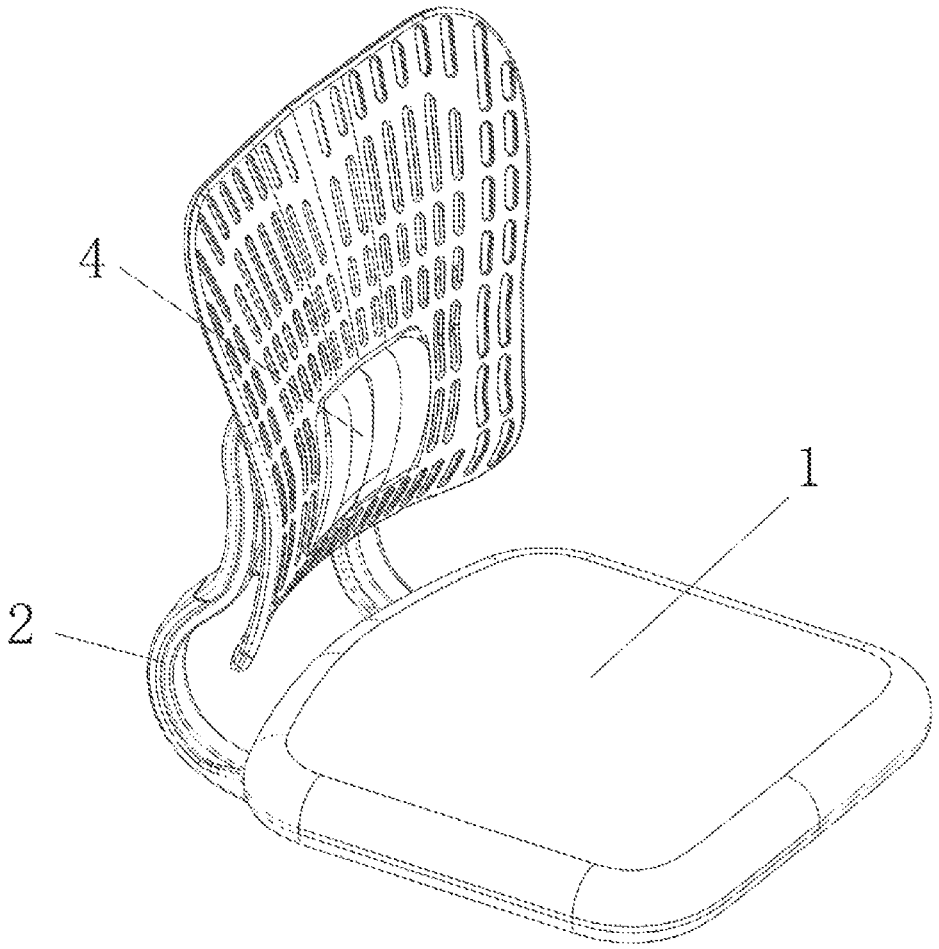
FIG. 1 is an overall structural schematic diagram of a connection bracket structure between seat cushion and chair back according to the present application.
Figure 2:
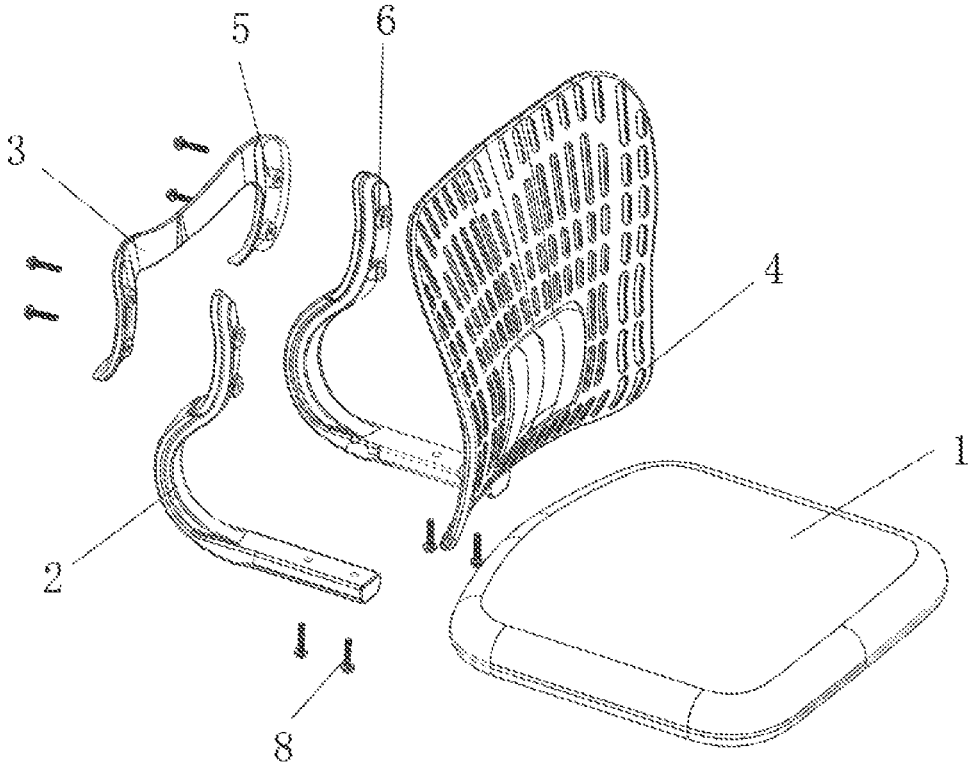
FIG. 2 is a structural exploded schematic diagram of the connection bracket structure between seat cushion and chair back according to the present application shown in FIG. 1.

1. Seat cushion; 2. Support frame; 3. Cross frame; 4. Chair back; 5. Positioning bump a; 6. Positioning bump b; 7. Positioning bump c; 8. Fastening screw.

DETAILED DESCRIPTION

In order to better understand the above purpose, features and advantages of the present application, the present application will be further described below in conjunction with the accompanying drawings and embodiments. It should be noted that, in the case of no conflict, the embodiments of the present application and the features in the embodiments can be combined with each other.

In the following description, numerous specific details are set forth in order to provide a thorough understanding of the present application. However, the present application may also be implemented in other ways than those described here. Accordingly, the present application is not limited to the specific examples disclosed in the following disclosure.

Embodiment 1, please refer to FIG. 1, FIG. 2, FIG. 4 and FIG. 5, a connection bracket structure between seat cushion and chair back, comprising a seat cushion 1, one side of the seat cushion 1 is provided with a support frame 2, and one side of the support frame 2 is provided with a cross frame 3, a side of the support frame 2 opposite to the cross frame 3 is provided with a chair back 4, the support frame 2 and the cross frame 3 are configured to be bent structures. By providing the support frame 2 with a bent structure, the shape of the chair back 4 is fitted, and meanwhile, the bent support frame 2 has higher strength. The cross frame 3, the support frame 2 and the chair back 4 are connected by fastening screws 8. Threaded holes are provided inside the chair back 4, and the threaded holes are engaged with fastening screws 8. By arranging the fastening screws 8, when the fastening screws 8 penetrate the inside of the support frame 2 and the chair back 4, they play the role of assembling the cross frame 3, the support frame 2 and the chair back 4.

Figure 3:
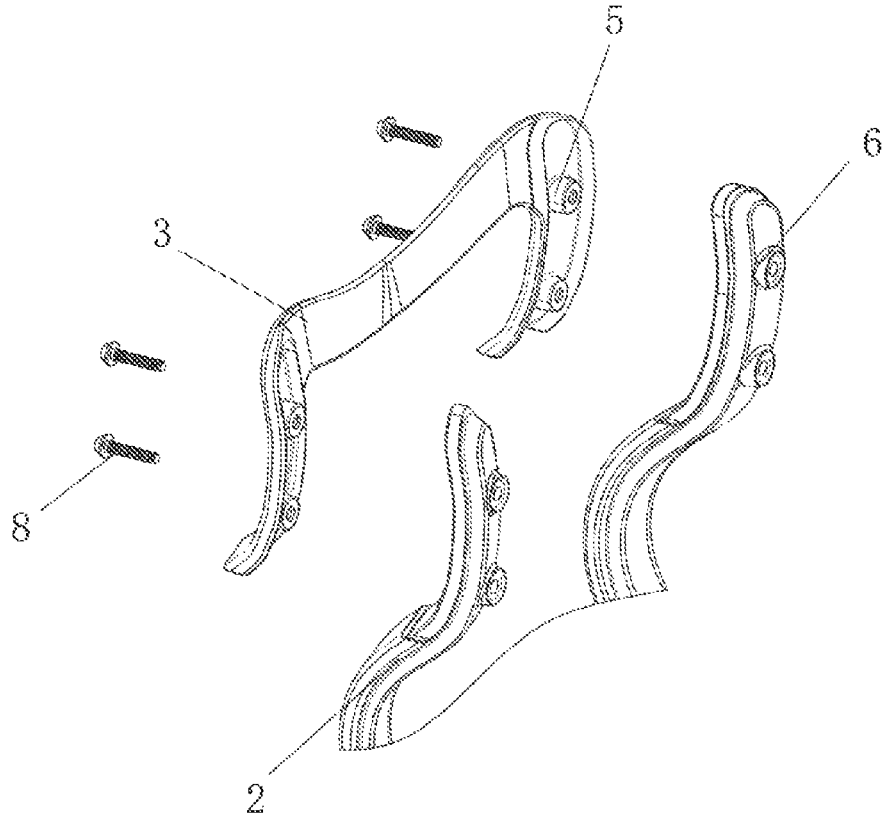
FIG. 3 is a partial structural schematic diagram at the position of the support frame in FIG. 2 in a connection bracket structure between seat cushion and chair back according to the present application.
Figure 4:
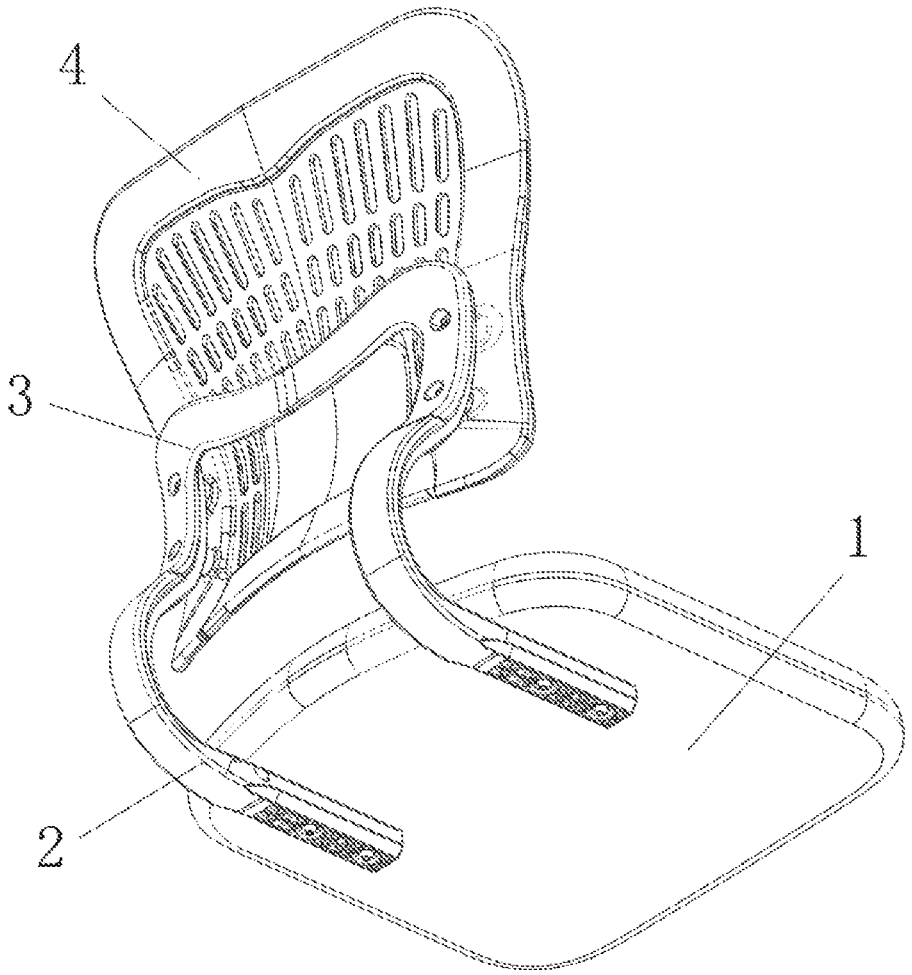
FIG. 4 is a bottom view of a connection bracket structure between seat cushion and chair back according to the present application.
Figure 5:
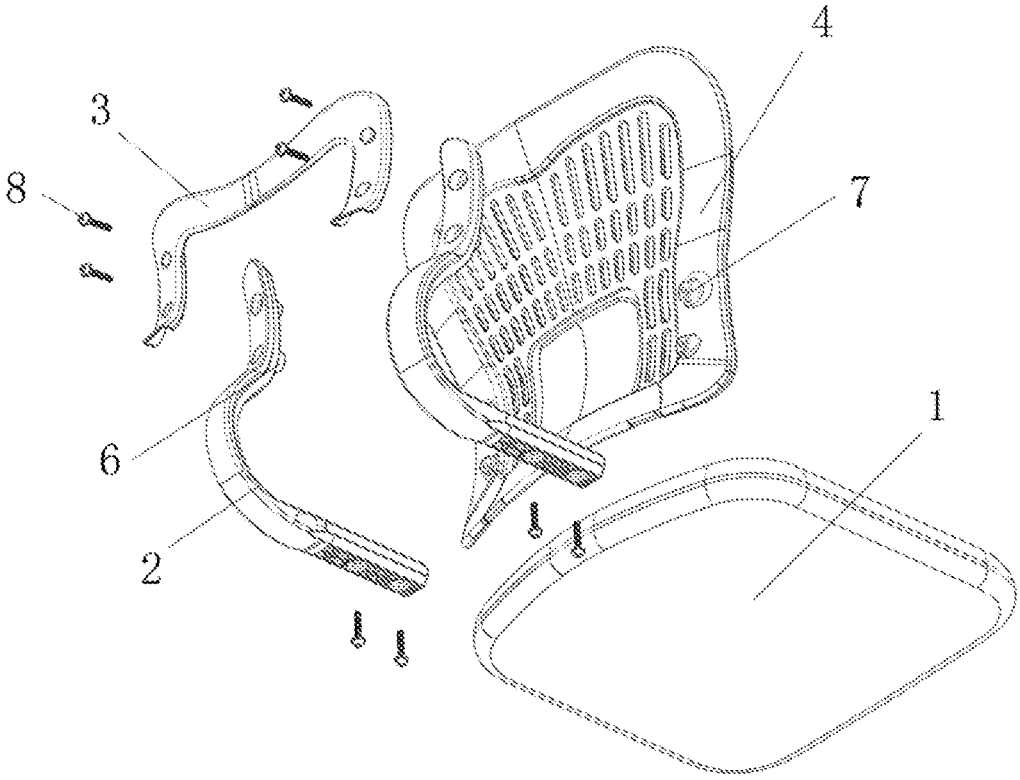
FIG. 5 is a structural exploded schematic diagram of the connection bracket structure between seat cushion and chair back according to the present application shown in FIG. 4.
Figure 6:
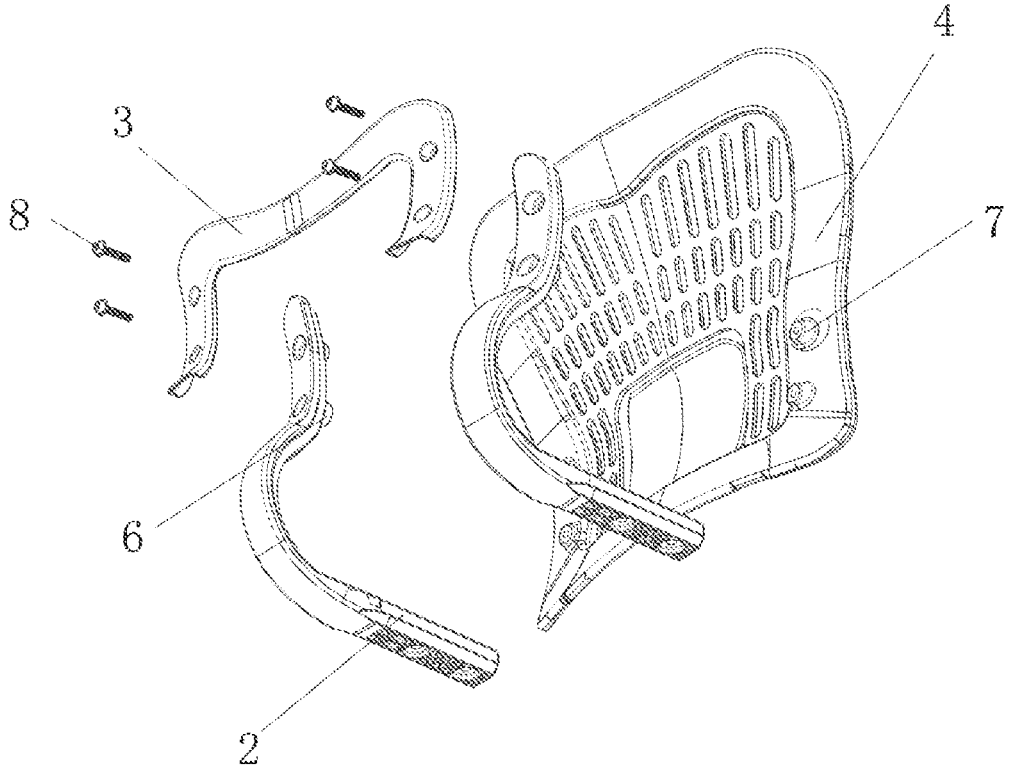
FIG. 6 is a partial structural schematic diagram at the position of the support frame, the cross frame and the chair back in FIG. 5 in a connection bracket structure between seat cushion and chair back according to the present application.

Please refer to FIG. 3 and FIG. 6, one side of the cross frame 3 is fixedly provided with positioning bump a 5, a side of the support frame 2 opposite to the positioning bump a 5 is configured to be an arc-shaped concave structure. One side of the support frame 2 is provided with positioning bump b 6, and surface of the positioning bump b 5 are also formed into a concave structure. one side of the chair back 4 opposite to the positioning bump b 6 is fixed with positioning bump c 7, and the positioning bump c 7 are symmetrically distributed on surface of the chair back 4. The supporting frame 2, the cross frame 3 and the chair back 4 can be preliminarily assembled together through the interlocking combination of the positioning bump a 5, the positioning bump b 6 and the positioning bump c 7.

Working principle: By providing the seat cushion 1, support frame 2, cross frame 3, chair back 4 and fastening screws 8, in actual installation, first insert the positioning bump a 5 on the cross frame 3 into the concave position on one side of the support frame 2. Next, attach the positioning bump b 6 on the side of the support frame 2 to the positioning bump c 7 on the side of the chair back 4. When the cross frame 3, the support frame 2 and the chair back 4 need to be combined, insert the fastening screws 8 into the support frame 2 and the cross frame 3, and then rotate the fastening screws 8. Because the interior of the chair back 4 is provided with threaded holes that engage with the fastening screws 8, when the fastening screws 8 are rotated, the fastening screws 8 will engage and move inside the chair back 4. When the fastening screws 8 completely penetrate to the inside of the chair back 4, the support frame 2, the cross frame 3 and the chair back 4 are fixed. After the support frame 2 is fixed, the bottom of the support frame 2 is located below the seat cushion 1, and finally the bottom surface of the support frame 2 and the swivel chair are fixed by fastening screws 8, thereby playing the role of installing the seat cushion 1.

The above are only preferred embodiments of the present application, and are not intended to limit the present application in other forms. Any person skilled in the art may make use of the technical content disclosed above to change or modify the equivalent embodiment to be applied in other fields. However, any simple modifications, equivalent changes and amendments made to the above embodiments according to the technical essence of the present application without departing from the content of the technical solution of the present application still belong to the protection scope of the technical solution of the present application.

What is claimed is:

1. A connection bracket structure between seat cushion and chair back, comprising a seat cushion (1), wherein one side of the seat cushion (1) is provided with a support frame (2), and one side of the support frame (2) is provided with a cross frame (3), a side of the support frame (2) opposite to the cross frame (3) is provided with a chair back (4), the cross frame (3), the support frame (2) and the chair back (4) are rotatably connected by fastening screws (8).

2. The connection bracket structure between seat cushion and chair back according to claim 1, wherein one side of the cross frame (3) is fixedly provided with positioning bump a (5), a side of the support frame (2) opposite to the positioning bump a (5) is configured to be an arc-shaped concave structure.

3. The connection bracket structure between seat cushion and chair back according to claim 2, wherein one side of the support frame (2) is provided with positioning bump b (6), and surface of the positioning bump b (6) are also formed into a concave structure.

4. The connection bracket structure between seat cushion and chair back according to claim 3, wherein one side of the chair back (4) opposite to the positioning bump b (6) is fixed with positioning bump c (7), and the positioning bump c (7) are symmetrically distributed on surface of the chair back (4).

5. The connection bracket structure between seat cushion and chair back according to claim 3, wherein the support frame (2) and the cross frame (3) are configured to be bent structures.

6. The connection bracket structure between seat cushion and chair back according to claim 5, wherein threaded holes are provided inside the chair back (4), and the threaded holes are engaged with fastening screws (8).

* * * * *